US012416454B2

(12) United States Patent
Mercer

(10) Patent No.: US 12,416,454 B2
(45) Date of Patent: Sep. 16, 2025

(54) LOUVERED FIN

(71) Applicant: Rheem Manufacturing Company, Atlanta, GA (US)

(72) Inventor: Kevin Mercer, Danville, IN (US)

(73) Assignee: Rheem Manufacturing Company, Atlanta, GA (US)

( * ) Notice: Subject to any disclaimer, the term of this patent is extended or adjusted under 35 U.S.C. 154(b) by 234 days.

(21) Appl. No.: 18/081,869

(22) Filed: Dec. 15, 2022

(65) Prior Publication Data

US 2023/0130189 A1 Apr. 27, 2023

Related U.S. Application Data

(63) Continuation-in-part of application No. 17/505,827, filed on Oct. 20, 2021, now Pat. No. 11,808,530.

(51) Int. Cl.
*F28F 1/32* (2006.01)

(52) U.S. Cl.
CPC ..... *F28F 1/325* (2013.01)

(58) Field of Classification Search
CPC ..... F28F 1/325; F28F 1/128; F28F 2215/08; F28F 2215/10; F28F 1/32; F25B 39/02; F28D 1/05333
See application file for complete search history.

(56) References Cited

U.S. PATENT DOCUMENTS 4,715,437 A 12/1987 Tanaka et al.
5,222,550 A 6/1993 Griffin et al.
5,975,198 A 11/1999 Kim et al.
8,156,999 B2 4/2012 Ishibashi et al.
2008/0190588 A1* 8/2008 Heidenreich ..... F28F 1/325 165/181

FOREIGN PATENT DOCUMENTS

| | | | | |
|---|---|---|---|---|
| DE | 3841180 C1 | 4/1990 | | |
| EP | 1837608 A1 | 9/2007 | | |
| JP | S-61243292 A | * 10/1986 | | ..... F28F 1/325 |
| JP | H0796994 B2 | 10/1995 | | |
| JP | 2007024419 A | 2/2007 | | |

OTHER PUBLICATIONS

PDF is translation of foreign reference JPS 61243292 A (Year: 1986).*
PCT, "International Search Report & Written Opinion" Application No. PCT/US2022/046079, malled Dec. 23, 2022, 15 pages.

* cited by examiner

*Primary Examiner* — Len Tran
*Assistant Examiner* — Kamran Tavakoldavani
(74) *Attorney, Agent, or Firm* — Eversheds Sutherland (US) LLP

(57) ABSTRACT

The present disclosure provides a louvered fin including a leading edge, a trailing edge, and a surface extending between the leading edge and the trailing edge. The surface defines a first set of holes along a first axis, a second set of holes along a second axis and offset from the first set of holes, and a third set of holes along a third axis and offset from the second set of holes. Each of the first axis, the second axis, and the third axis extends substantially parallel to a longitudinal axis of the fin. A first offset distance between the second and first set of holes is greater than a second offset distance between the third and second set of holes. The second and the third set of holes define a substantially obtuse trapezoidal matrix.

23 Claims, 13 Drawing Sheets

LOUVERED FIN

CROSS-REFERENCE TO RELATED APPLICATIONS

This application is a continuation-in-part application of U.S. patent application Ser. No. 17/505,827, filed on Oct. 20, 2021, the entire contents of which is incorporated herein by reference.

TECHNICAL FIELD

The present disclosure relates, in general, to a heat exchanger fin and, more specifically relates, to a louvered fin for an evaporator coil.

BACKGROUND

Typically, the condenser coil and the evaporator coil of a heating, ventilation, and air conditioning (HVAC) system are each designed to exchange thermal energy with internal tubing for carrying refrigerant. Each of the condenser coil and the evaporator coil often includes a plurality of fins disposed along a length of the internal tubing, such that adjacent fins are substantially parallel to each other and located apart by a predefined distance. Further, the internal tubing passes through holes defined in the adjacently located fins.

Generally, the condenser coil and the evaporator coil include fins with substantially similar constructional features. Although such similarity in constructional features aid streamlined manufacturing, performance of the fin, such as heat transfer efficiency, may be affected by using similar fins in each of the condenser coil and the evaporator coil. It is required to incorporate condensate management features in the fins implemented in the evaporator coil, while the same may not be a mandate for the condenser coil. As such, design of fins may be made for better performance based on end-use application.

SUMMARY

According to one aspect of the present disclosure, a louvered fin is disclosed. The louvered fin includes a leading edge, a trailing edge opposite to the leading edge, and a surface extending between the leading edge and the trailing edge. The surface defines a plurality of holes, in which a first set of holes are defined along a first axis, a second set of holes are defined along a second axis, and a third set of holes are defined along a third axis. Each of the first axis, the second axis, and the third axis extends substantially parallel to a longitudinal axis of the fin. The second set of holes are offset from the first set of holes along the longitudinal axis of the fin and the third set of holes are offset from the second set of holes along the longitudinal axis of the fin. A first offset distance defined between the second set of holes and the first set of holes is greater than a second offset distance defined between the third set of holes and the second set of holes. The second set of holes and the third set of holes define a substantially obtuse trapezoidal matrix.

In an embodiment, the louvered fin further includes a fourth set of holes defined along a fourth axis extending substantially parallel to the longitudinal axis of the fin.

In an embodiment, the surface extending between the leading edge and the trailing edge is wavy. In an embodiment, each of two opposite wider angles of the obtuse trapezoidal matrix is in a range of about 95 degrees to about 105 degrees.

In an embodiment, a distance between the leading edge and the first axis is in a range of about 0.25 inch to about 0.5 inch. In an embodiment, a distance between the first axis and the second axis is in a range of about 0.50 inch to about 1 inch. In an embodiment, a distance between the third axis and the trailing edge is in a range of about 0.25 inch to about 0.5 inch. In an embodiment, a distance between two adjacent holes of the first set of holes is in a range of about 1 inch to about 0.75 inch.

In an embodiment, a distance between two adjacent holes of the second set of holes is in a range of about 1 inch to about 0.75 inch. In an embodiment, the first offset distance between the first axis and the second axis of holes is in a range of about 0.375 inch to about 0.5 inch. In an embodiment, a diameter of each hole of the first set of holes, the second set of holes, and the third set of holes is in a range of about 6.8 mm to about 4.8 mm.

In an embodiment, the louver fin further includes a plurality of collars, where each collar extends from a periphery of one hole of the plurality of holes. Preferably, each collar extends in a direction perpendicular to the surface of the fin. Each collar includes a narrow portion and an expanded portion, where the expanded portion is distal from the surface of the fin.

According to another aspect of the present disclosure, an evaporator coil is disclosed. The evaporator coil includes a plurality of refrigerant tubes and a plurality of louvered fins. Each louvered fin includes a leading edge, a trailing edge opposite to the leading edge, and a surface extending between the leading edge and the trailing edge. The surface defines a plurality of holes configured to allow the plurality of refrigerant tubes to pass therethrough. A first set of holes of the plurality of holes are defined along a first axis, a second set of holes of the plurality of holes are defined along a second axis, and a third set of holes of the plurality of holes are defined along a third axis. Each of the first axis, the second axis, and the third axis extends substantially parallel to a longitudinal axis of the fin. The second set of holes are offset from the first set of holes along the longitudinal axis of the fin and the third set of holes are offset from the second set of holes along the longitudinal axis of the fin. A first offset distance defined between the second set of holes and the first set of holes is greater than a second offset distance defined between the third set of holes and the second set of holes. The second set of holes and the third set of holes define a substantially obtuse trapezoidal matrix.

In an embodiment, each of the plurality of louvered fins is made from aluminum alloy. In an embodiment, each of the plurality of holes forms an interference fit with an outer surface of a refrigerant tube passing therethrough.

In an embodiment, each of the plurality of louvered fins defines at least one cropped corner. In an embodiment, each of the plurality of louvered fins further includes gagged regions located around peripheries of the hole defined proximal to the at least one cropped corner.

In an embodiment, the evaporator coil further includes a plurality of collars, where each collar extends from a periphery of one hole of the plurality of holes. A length of each collar is in a range of about 1.4 mm to about 1.8 mm.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

Aspects of the present disclosure are directed to a louvered fin and an evaporator coil implementing the louvered fin. The louvered fin has a unique design to aid enhanced condensate drainage and enable structural robustness. Additionally, configuration of louvers in the fin form boundary layers of convective heat transfer between air flowing, with an inclined angle of attack, across small diameter tubes extending across the fins.

Figure 1A:
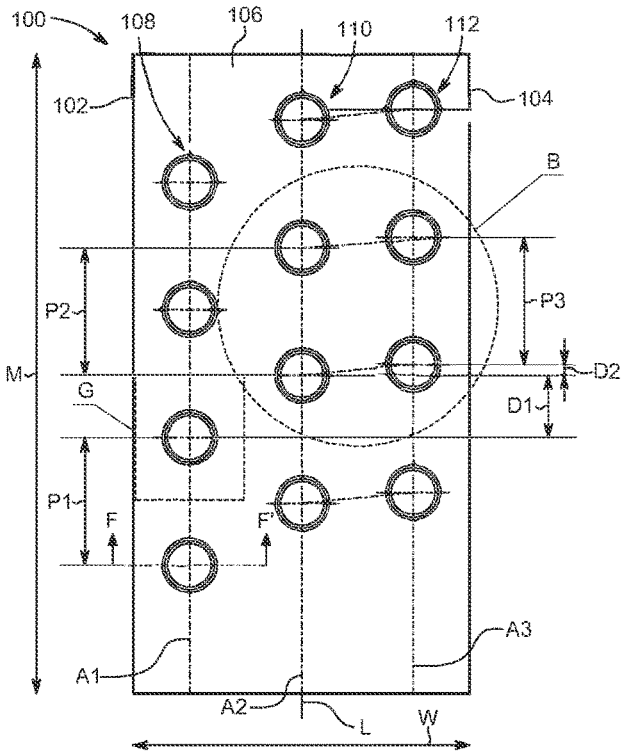
FIG. 1A is a front view of a louvered fin, according to an embodiment of the present disclosure.

Referring to FIG. 1A, a front view of a louvered fin 100 is illustrated, according to an embodiment of the present disclosure. The louvered fin 100 (hereinafter referred to as "the fin 100") includes a leading edge 102 and a trailing edge 104 opposite to the leading edge 102. As used herein, the term "leading edge" refers to a feature of the fin 100 that is upstream with respect to a direction of flow of air across the fin 100 and the term "trailing edge" refers to a feature of the fin 100 that is relatively downstream with respect to the direction of flow of air across the fin 100. These terminologies are well known in the art of fins, for example heat exchanger fins. The fin 100 further includes a surface 106 extending between the leading edge 102 and the trailing edge 104. Preferably, the surface 106 is wavy in structure. As used herein, the term "wavy" refers to a structure of the fin 100 including adjacent concave and convex portions, or multiple crests and troughs, along a width "W" of the fin 100. In an embodiment, a length "M" of the fin 100 may be in a range of about 2 inches to 6 inched or 3.8 inches to about 4.5 inches and the width "W" of the fin 100 may be in a range of about 1 inches to 4 inches or 1.9 inches to about 2.5 inches. According to an aspect of the present disclosure, multiple fins, each having a configuration described below, are stacked to constitute a heat exchanging medium of an evaporator coil. The fin 100 may also be suitably implemented in, but not limited to, indoor air handler of residential split systems, both heat pumps and air conditioners.

Further, the surface 106 of the fin 100 defines a plurality of holes including a first set of holes 108, a second set of holes 110, and a third set of holes 112. Each of the plurality of holes is configured to allow a refrigerant tube (not shown) of the evaporator coil to pass therethrough. The phrase "set of holes" may be alternatively referred to and understood as "row of holes". In an embodiment, a diameter of each hole of the first set of holes 108, the second set of holes 110, and the third set of holes 112 is in a range of about 4.8 mm to about 6.8 mm, and preferably 7 mm. According to an aspect of the present disclosure, the fin 100 preferably includes three rows of holes as illustrated in FIG. 1A. The first set of holes 108 are defined along a first axis "A1" located proximal to the leading edge 102 of the fin 100. In an embodiment, a distance between the leading edge 102 and the first axis "A1" is in a range of about 0.1 inch to about 0.5 inch. In another embodiment, the distance between the leading edge 102 and the first axis "A1" is preferably 0.3625 inch. Further, in an embodiment, a distance between two adjacent holes of the first set of holes 108, which defines a first pitch "P1", is in a range of about 0.5 inch to about 1 inch. In some embodiments, preferably, the first pitch "P1" along the first axis "A1" is 0.827 inch.

The second set of holes 110 are defined along a second axis "A2" and are offset from the first set of holes 108 along a longitudinal axis "L" of the fin 100. The second axis "A2"

extends along the longitudinal axis "L" and is located between the first axis "A1" and the trailing edge 104. For the purpose of brevity, the second axis "A2" is shown coinciding with the longitudinal axis "L". In an embodiment, a distance between the first axis "A1" and the second axis "A2" is in a range of about 0.50 inch to about 1 inch. In another embodiment, distance between the first axis "A1" and the second axis "A2" is preferably 0.725 inch. Further, in an embodiment, a distance between two adjacent holes of the second set of holes 110, which defines a second pitch "P2", is in a range of about 0.5 inch to about 1 inch. In some embodiments, preferably, the second pitch "P2" along the second axis "A2" is 0.827 inch.

Further, the third set of holes 112 are defined along a third axis "A3" that is located proximal to the trailing edge 104 of the fin 100. In an embodiment, a distance between the third axis "A3" and the trailing edge 104 is in a range of about 0.1 inch to about 0.5 inch. In another embodiment, the distance between the third axis "A3" and the trailing edge 104 is preferably 0.3625 inch. The third set of holes 112 are offset from the second set of holes 110 along the longitudinal axis "L" of the fin 100. Further, in an embodiment, a distance between two adjacent holes of the third set of holes 112, which defines a third pitch "P3", is in a range of about 0.5 inch to about 1 inch. In some embodiments, preferably, the third pitch "P3" along the third axis "A3" is 0.827 inch. Each of the first axis "A1", the second axis "A2", and the third axis "A3" extends substantially parallel to the longitudinal axis "L" of the fin 100.

The second set of holes 110 are offset at a first offset distance "D1" from the first set of holes 108 and the third set of holes 112 are offset at a second offset distance "D2" from the first set of holes 108. Preferably, the second offset distance "D2" is less than the first offset distance "D1". In an embodiment, the first offset distance "D1" is in a range of about 0.1 inch to about 0.5 inch. In some embodiment, the first offset distance "D1" preferably is 0.4135 inch. For the purpose of the present disclosure, the offset distances are calculated with respect to centers of the holes as indicated in the FIG. 1A.

Figure 1B:
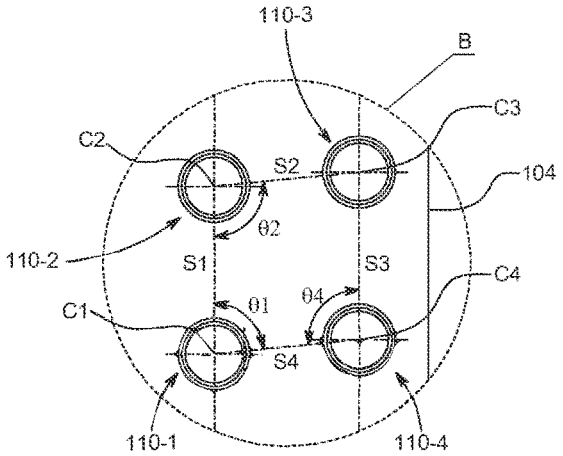
FIG. 1B is an enlarged view of a portion of the louvered fin of FIG. 1A, according to an embodiment of the present disclosure.

FIG. 1B is an enlarged view of a portion "B" of FIG. 1A, according to an embodiment of the present disclosure. As can be seen from FIG. 1B, the third set of holes 112 are offset from the second set of holes 110 along the longitudinal axis "L". As such, the second set of holes 110 and the third set of holes 112 define a substantially obtuse trapezoidal matrix. An obtuse trapezoid refers to a geometric shape including one acute angle and one obtuse angle defined on a base thereof. For example, centers "C1" of a first hole 110-1, "C2" of a second hole 110-2, "C3" of a third hole 112-1, and "C4" of a fourth hole 112-2 define vertices of the obtuse trapezoid. Line segments "S1" extending between "C1" and "C2", "S2" extending between "C2" and "C3", "S3" extending between "C3" and "C4", and "S4" extending between "C4" and "C1" define sides of the obtuse trapezoid. Line segments "S1" and "S4" define an acute angle "θ1", "S1" and "S2" define an obtuse angle "θ2", and similarly "S3" and "S4" define an obtuse angle "θ4". As such, "θ2" and "θ4" are two opposite wider angles of the obtuse trapezoid. In an embodiment, each of the two opposite wider angles of the obtuse trapezoid is in a range of about 95 degrees to about 105 degrees. Similarly, adjacent set of four holes define another obtuse trapezoid. As such, owing to the offset, the second set of holes 110 and the third set of holes 112 define an array of obtuse trapezoids along the longitudinal axis "L" of the fin 100, which together constitutes the obtuse trapezoidal matrix.

Figure 1C:
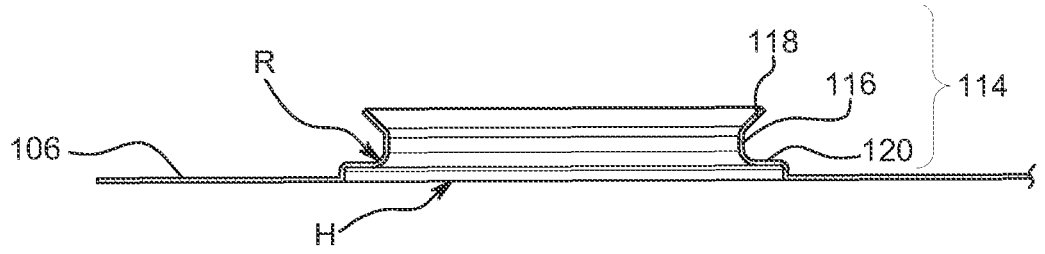
FIG. 1C is a cross-section of a portion of the louvered fin of FIG. 1A, according to an embodiment of the present disclosure.

FIG. 1C illustrates a cross-section of a portion of the fin 100 considered along a section F-F' in FIG. 1A. In an embodiment, the fin 100 further includes a plurality of collars, where each collar extends from a periphery of one hole of the plurality of holes. As shown in FIG. 1C, a collar 114 extends from the periphery of the hole "H" defined in the surface 106 of the fin 100. Particularly, each collar, such as the collar 114, extends in a direction perpendicular to the surface 106 of the fin 100. In an embodiment, the collar 114 includes a narrow portion 116 and an expanded portion 118 extending from the narrow portion 116. The expanded portion 118 is distal from the surface 106 of the fin 100. The collar 114 narrows from the periphery of the hole "H" to the narrow portion 116 through a step portion 120. In order to minimize stress concentration in the collar 114, the narrow portion 116 and the step portion 120 defines a fillet at a connection portion thereof, having a radius of curvature "R". In an embodiment, a length of each collar is in a range of about 1.4 mm to about 1.8 mm. However, in some embodiments, the length of the collar 114 may be determined based on fins-per-inch factor of the evaporator coil.

According to an aspect, each of the plurality of holes forms an interference fit with an outer surface of the refrigerant tube passing therethrough. For the sake of brevity in illustration and description, the evaporator coil and the refrigerant tubes are not illustrated and particularly described as they are well known in the art. The collar 114, and other collars formed in the fin 100, serve to increase mechanical strength of a joinder, such as the interference fit, between the fin 100 and the corresponding refrigerant tube. The collar 114 also serves to increase the heat conductivity between the refrigerant tubes and the fin 100. In some embodiments, the surface 106 of the fin 100, the refrigerant tubes, and the collar 106 may each be manufactured from a suitable thermally-conductive material, such as, but not limited to, copper, aluminum, and alloys thereof. In the present disclosure, the fin 100 is made from aluminum alloy.

Figure 2:
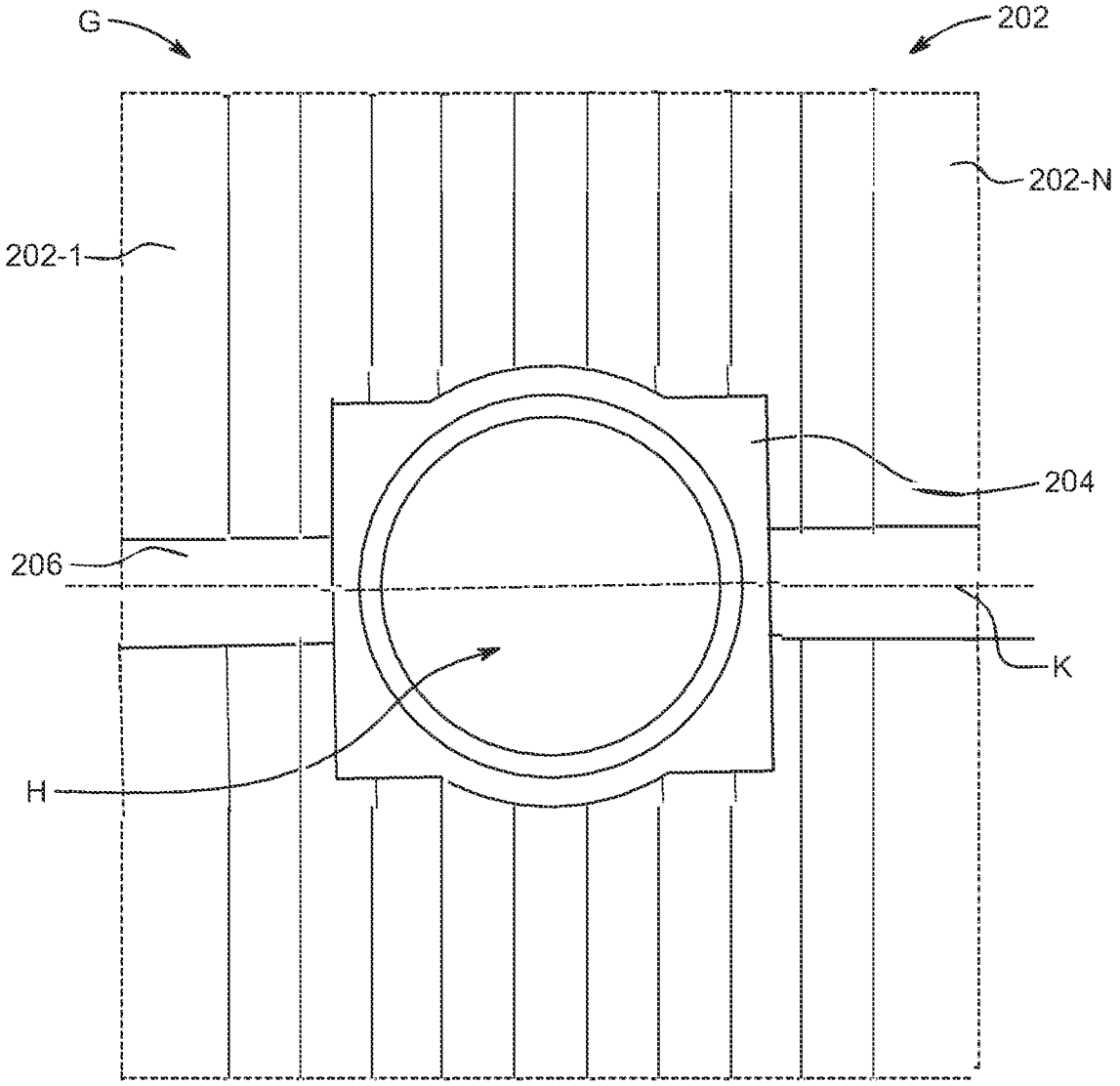
FIG. 2 is an enlarged portion of the louvered fin of FIG. 1A, according to an embodiment of the present disclosure.

FIG. 2 illustrates an enlarged portion "G" of FIG. 1A. Particularly, the enlarged portion "G" includes the hole "H" of the first set of holes 108. The fin 100 includes a plurality of louvers 202 extending along the longitudinal axis "L" of the fin 100. In an embodiment, the fin 100 includes a predefined region 204 around the hole "H" configured, for example, to add to the strength of the collar 114 extending from the periphery of the hole "H". As can be seen in FIG. 2, the predefined region 204 includes a rectangular portion, where a pair of opposite sides of the rectangular portion includes an arcuate portion. Along a horizontal axis "K", the fin 100 includes a sleeve 206 free from the louvers 202. In other words, the louvers 202 are not formed in the sleeve 206. Additionally, the predefined region 204 is also free from the louvers 202. When the refrigerant pipe is inserted through the hole "H", the predefined region 204 and the sleeve 206 may together add strength to the collar 114 extending from the periphery of the hole "H", which otherwise would be weak if the louvers 202 were extending up to the collar 114. In an example, a width of the sleeve 206 may be about 2 mm. The louvers 202 at extremities, such as a left extreme louver 202-1 and a right extreme louver 202-N, are wider as compared to intermediate louvers located therebetween. In an example, width of each of louver at the extremities may be about 2.25 mm and width of each intermediate louver may be about 1.5 mm. In some embodiments, the fin 100 may include nine intermediate louvers. FIG. 2 illustrates the louvers 202 associated with the first set of holes 108. The second set of holes 110 and third set of holes 112 are neighbored by similar set of louvers 202. In some embodiments, number of louvers associated with each row of holes may be equal, for example 11 louvers as illustrated in FIG. 2. In some embodiments, the number of louvers may vary between adjacent rows of holes.

Figure 3:
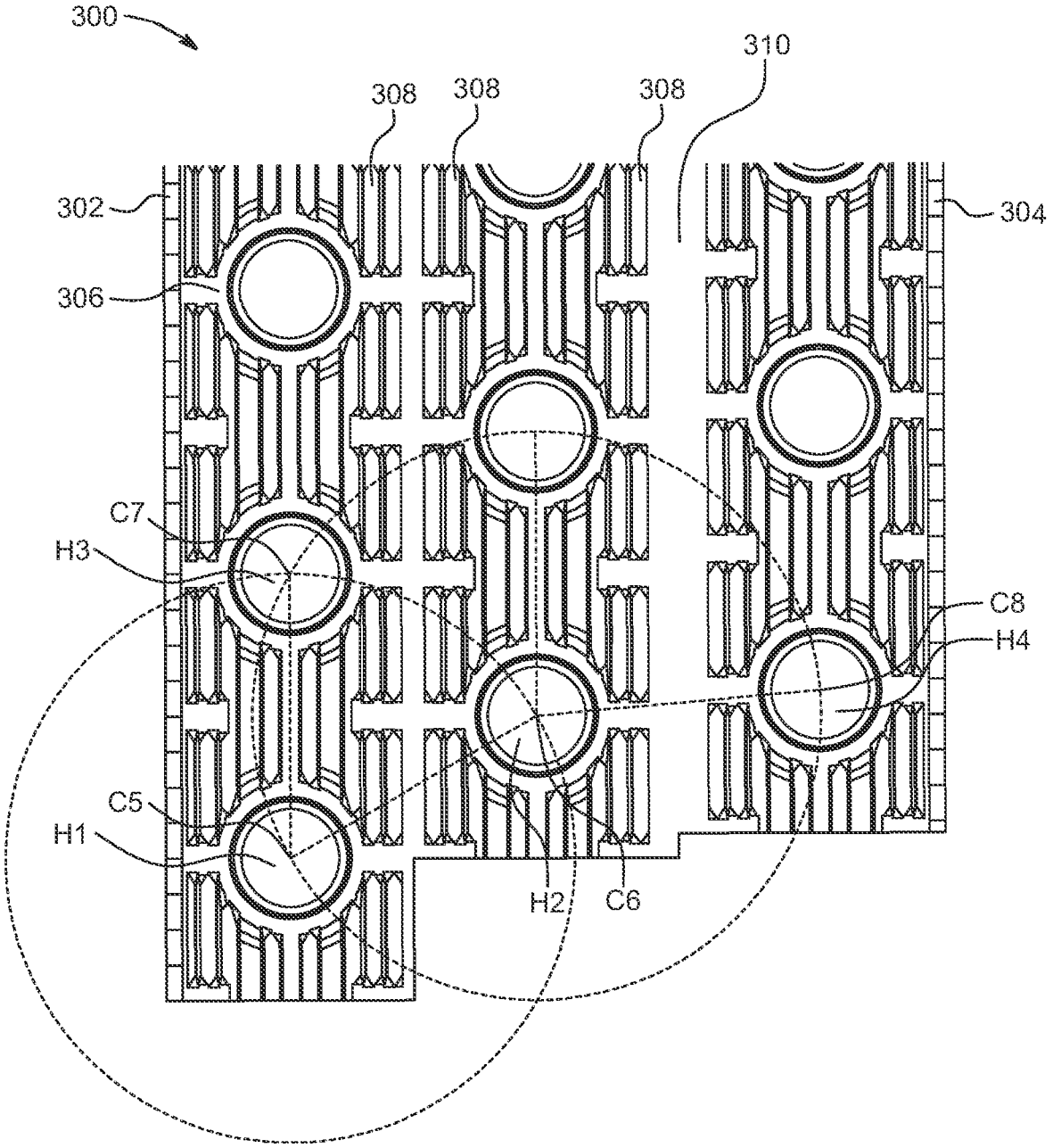
FIG. 3 is a portion of another louvered fin, according to another embodiment of the present disclosure.
Figure 5:
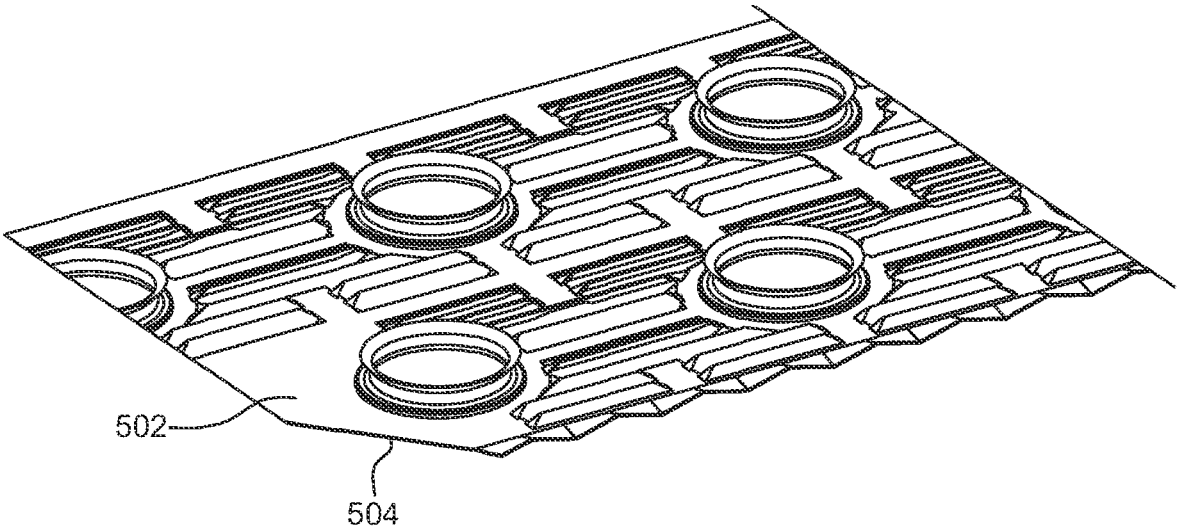
FIG. 5 is an enlarged portion of the louvered fin of FIG. 3, according to an embodiment of the present disclosure.

FIG. 3 illustrates a portion of a fin 300, according to another embodiment of the present disclosure. Each of a leading edge 302 and a trailing edge 304 of the fin 300 has a rippled edge, such as a zig-zag pattern (as shown in FIG. 5). A predefined region 306 extends around a circumference of each hole of each row of holes. In an embodiment, louvers 308 are formed to define an X-shape pattern along a surface 310 of the fin 300. In the illustrated embodiment, the fin 300 includes ten louvers 308. In other embodiments, the fin 300 may include any number of louvers 300 based on a width and pitch of the fin 300. Besides being offset, the holes of the second row are defined at a radial distance from the holes of the first row. For example, a distance between center "C5" of a first hole "H1" in the first row of holes and center "C6" of a first hole "H2" in the second row of holes is 21 mm. A circumference of an imaginary circle considered with "C5" as the center, passes through center "C7" of a second hole "H3" in the first set of holes. As such, the center "C7" is also at radial distance from the center "C5", thereby defining the pitch of the fin 300. Similarly, a circumference of another imaginary circle considered with "C6" as the center, passes through center "C8" of a first hole "H4" of the third row of holes and the center "C5" of the first hole "H1" of the first row of holes. As such, the third row of holes are also defined at the same radial distance from the second row of holes. Such design of the fin 300, and that of the fin 100 of FIG. 1A, may eliminate overlap of holes and louvers with adjacent row of holes and louvers, thereby achieving an increase in heat transfer efficiency.

Figure 4:
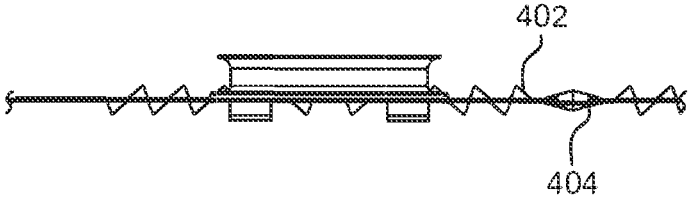
FIG. 4 is a side view of the louvered fin of FIG. 3, according to an embodiment of the present disclosure.

FIG. 4 illustrates a side view of the fin 300. In an embodiment, the fin 300 includes half louvers 402 at the edges of the fin 300, such as the leading edge 302 and the trailing edge 304, and full louvers at remaining portion of the surface 310 of the fin 300. As used herein, the term "full louver" refers to complete length of the louver extending across the surface 310 of the fin 300 and the term "half louver" refers to half length of the louver extending from the surface 310 of the fin 300. FIG. 4 also shows a joint 404 formed between two fins. At the joint 404, the trailing edge of one fin contacts a leading edge of an adjacent fin. Conventional joining processes known to a person skilled in the art to join the rippled edges of the contacting portions of the two fins may be performed to achieve a wider fin array (not shown). In an embodiment, the louvers 308 extend at an angle of about 45 degrees with respect to the surface 310 of the fin 300. In other embodiments, the louvers 308 may be inclined at any preferred acute angle.

FIG. 5 illustrates a portion of the fin 300, according to another embodiment of the present disclosure. The louvers 308 extending to an end of the fin 300 may be subjected to damage or may be directed in random directions during assemblage into the evaporator coil. In order to overcome such damage, in an embodiment, the fin 300 includes gagged regions 502 around the peripheries of the holes defined proximal to the ends of the fin 300. Preferably, the gagged regions 502 are formed around the holes defined proximal to at least one cropped corner 504 in the fin 300. The gagged portions 502 do not include any louvers 308 and hence may add to the strength of the fin 300 at the cropped corner 504.

Figure 6A:
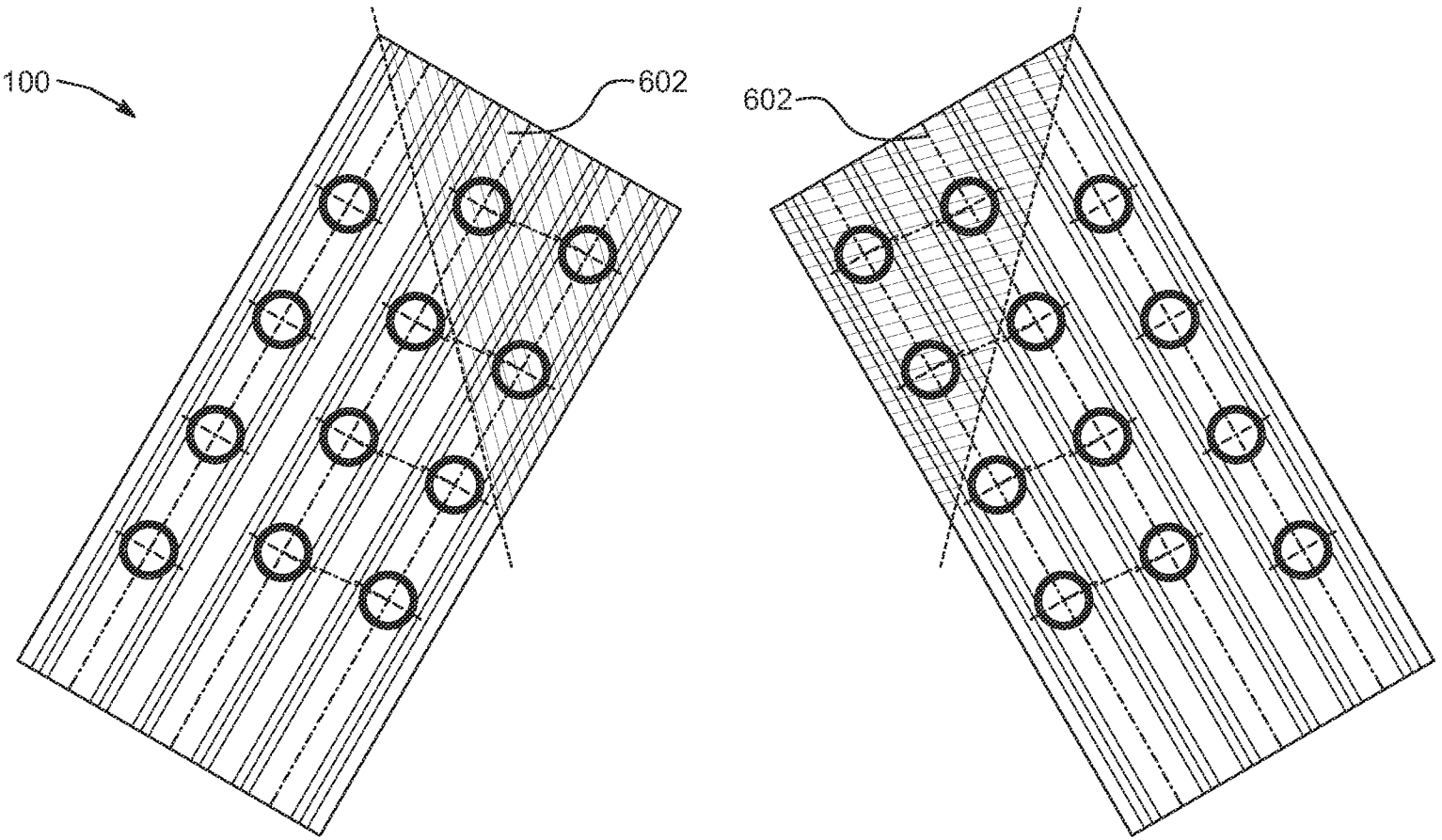
FIG. 6A shows a louvered fin having a cropped corner, according to an embodiment of the present disclosure.
Figure 6B:
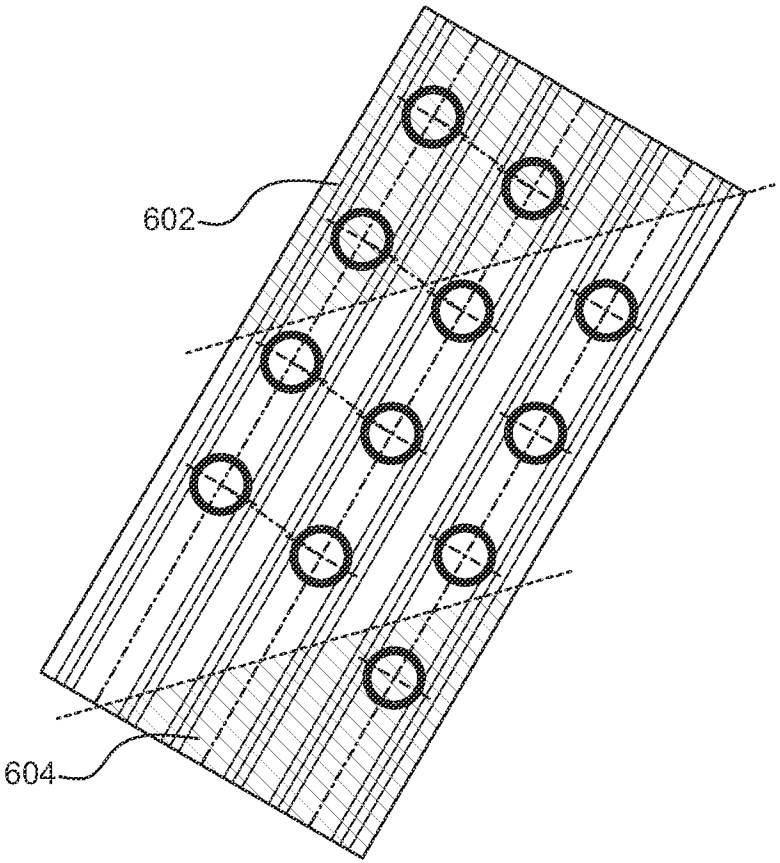
FIG. 6B shows a louvered fin having a pair of cropped corners, according to an embodiment of the present disclosure.
Figure 6B:
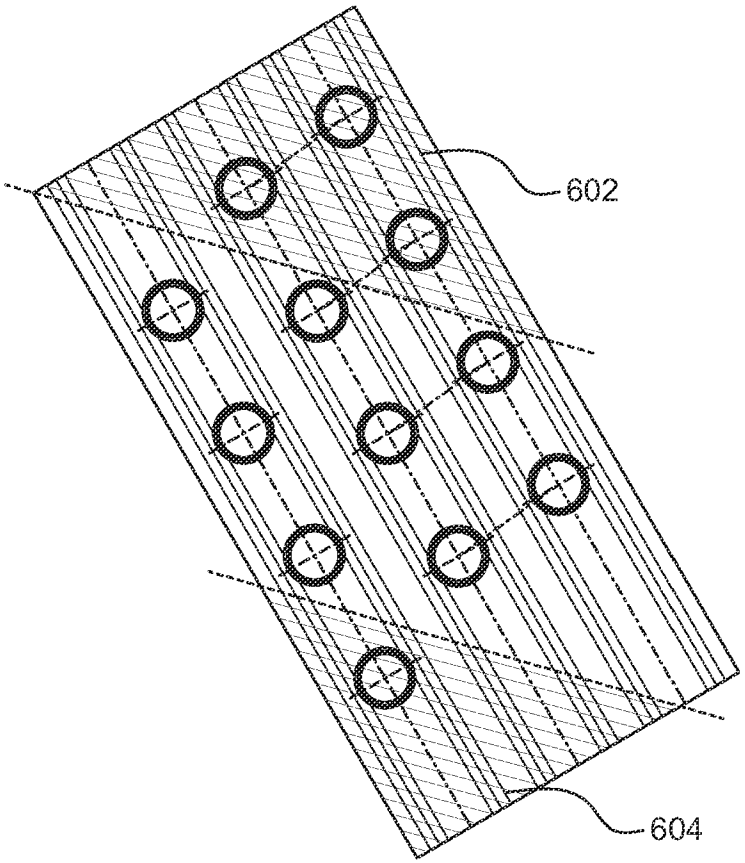

FIGS. 6A and 6B illustrates fins showing cropped corners. Particularly, FIG. 6A illustrates fins, such as the fin 100, 300, with corners designated for cropping. Hatched portions 602 are indicative of corners that are designated for cropping. The fins are positioned in an inclined manner, for example along arms of alphabet "A". Multiple such fins may be stacked together to constitute a "A-type" evaporator coil. The cropped corners aid in reducing the size of such evaporator coils, in case of space constraints in an end-use application. FIG. 6B illustrates a pair of hatched portions 602, 604 designated for cropping in each fin. The fins in FIG. 6B are oriented in an inclined manner, for example along arms of alphabet "V". Multiple such fins with double cropped corners may be stacked to constitute a smaller evaporator coil based on space available in the end-use application. As such, the fins may be configured to constitute the evaporator coil of desired shape and size. In some embodiments, "N-type", "Z-type", or slab type evaporator coils may be formed in similar manner by positioning the fins, with or without cropped corners, in inclined manner and stacking with refrigerant pipes. However, it may be ensured that cutting line(s) to form the cropped corners does not interfere with the holes defined in the fins and does not lie close to the periphery of the holes. It will be understood to the person skilled in the art that the louvers at the cropped corners need to be handled carefully while stacking multiple such fins to constitute the evaporator coil. In some embodiment, the fins with cropped corners may include gagged regions, such as the regions 502, around the peripheries of the hole defines proximal to the cropped corners. In some embodiments, the fin may include two or more cropped corners.

Figure 7A:
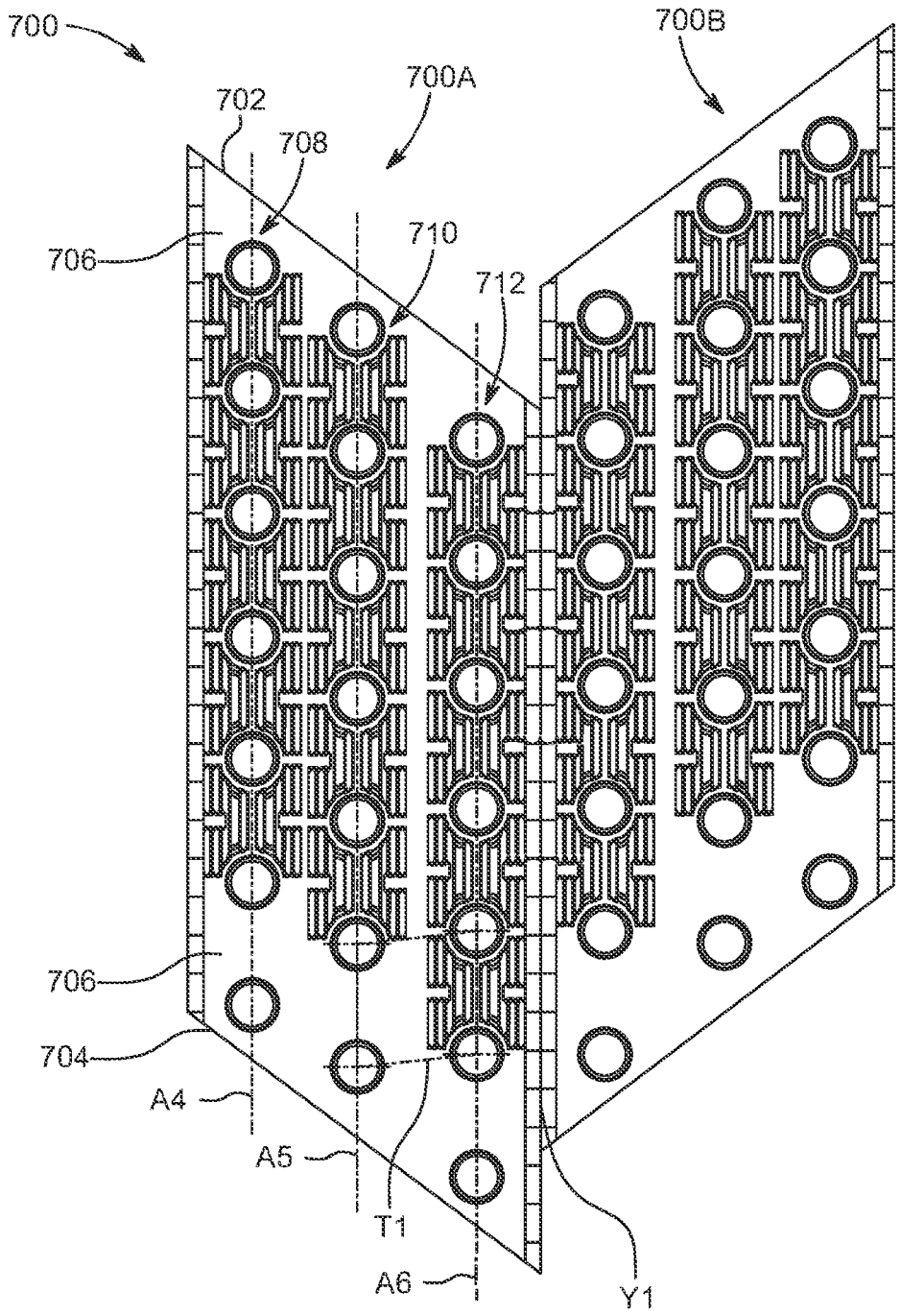
FIG. 7A is a front view of a louvered fin defining three rows of holes, and having cropped corners and gagged regions, according to another embodiment of the present disclosure.

FIG. 7A illustrates a front view of a louvered fin 700, according to another embodiment of the present disclosure. Preferably, two fins 700A and 700B may be die stamped on an aluminum sheet to achieve the design illustrated in FIG. 7A. Further, the fin 700A may be separated from the fin 700B, by known means, along a line of contact "Y1". Upon separation, multiple such fins may be disposed adjacent to each other and may be stacked together with refrigerant tubes. Each of the fins 700A, 700B includes three rows of holes defined between cropped corners 702, 704, and gagged regions 706 around holes defined proximal to the cropped corners 702, 704. For the purpose of brevity, configuration of the fin 700A is described herein. A first row of holes 708 is defined along a first axis "A4", a second row of holes 710 is defined along a second axis "A5", and a third row of holes 712 is defined along a third axis "A6". Each axis extends substantially parallel to a longitudinal axis of the fin 700A. The second row of holes 710 are offset from the first row of holes 708 in a direction along a length of the fin 700A, and the third row of holes 712 are offset from the second row of holes 710 in the direction along the length of the fin 700A. The second row of holes 710 and the third row of holes define a substantially obtuse trapezoidal matrix. For the purpose of illustration, one obtuse trapezoid "T1" is indicated in fin 700A. Interior angles each obtuse trapezoid formed in the fin 700A may preferably be equal to those described with respect to FIG. 1B.

Figure 7B:
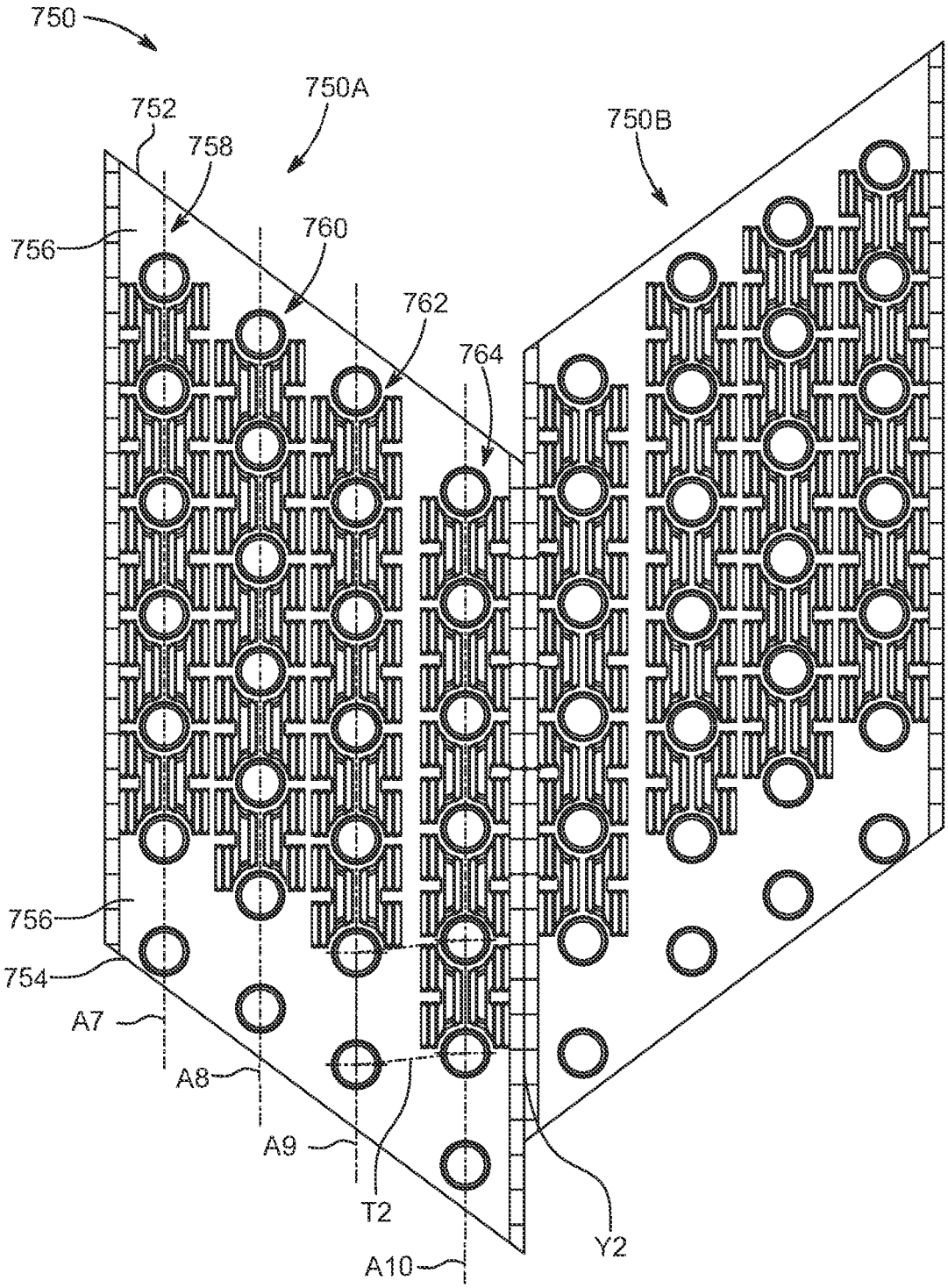
FIG. 7B is a front view of a louvered fin defining four rows of holes, and having cropped corners and gagged regions, according to another embodiment of the present disclosure.

FIG. 7B illustrates a front view of a louvered fin 750, according to another embodiment of the present disclosure. Preferably, two fins 750A and 750B may be die stamped on an aluminum sheet to achieve the design illustrated in FIG. 7B. Further, the fin 750A may be separated from the fin 750B, by known means, along a line of contact "Y2". Upon separation, multiple such fins may be disposed adjacent to each other and may be stacked together with refrigerant tubes. Each of the fins 750A, 750B includes four rows of holes defined between cropped corners 752, 754, and gagged regions 756 around holes defined proximal to the cropped corners 752, 754. For the purpose of brevity, configuration of the fin 750A is described herein. The fin 750A includes a first row of holes 758 defined along a first axis "A7", a second row of holes 760 defined along a second axis "A8" and offset from the first row of holes 758, a third row of holes 762 defined along a third axis "A9" and offset from the second row of holes 760, and a fourth row of holes 764 defined along a fourth axis "A10" and offset from the third row of holes 762. Each axis extends substantially parallel to a longitudinal axis of the fin 750A. Geometrically, the third row of holes 760 and the fourth row of holes 762 define a substantially obtuse trapezoidal matrix. For the purpose of illustration, one obtuse trapezoid "T2" is indicated in fin 750A. Interior angles each obtuse trapezoid formed in the fin 750A may preferably be equal to those described with respect to FIG. 1B.

Figure 8:
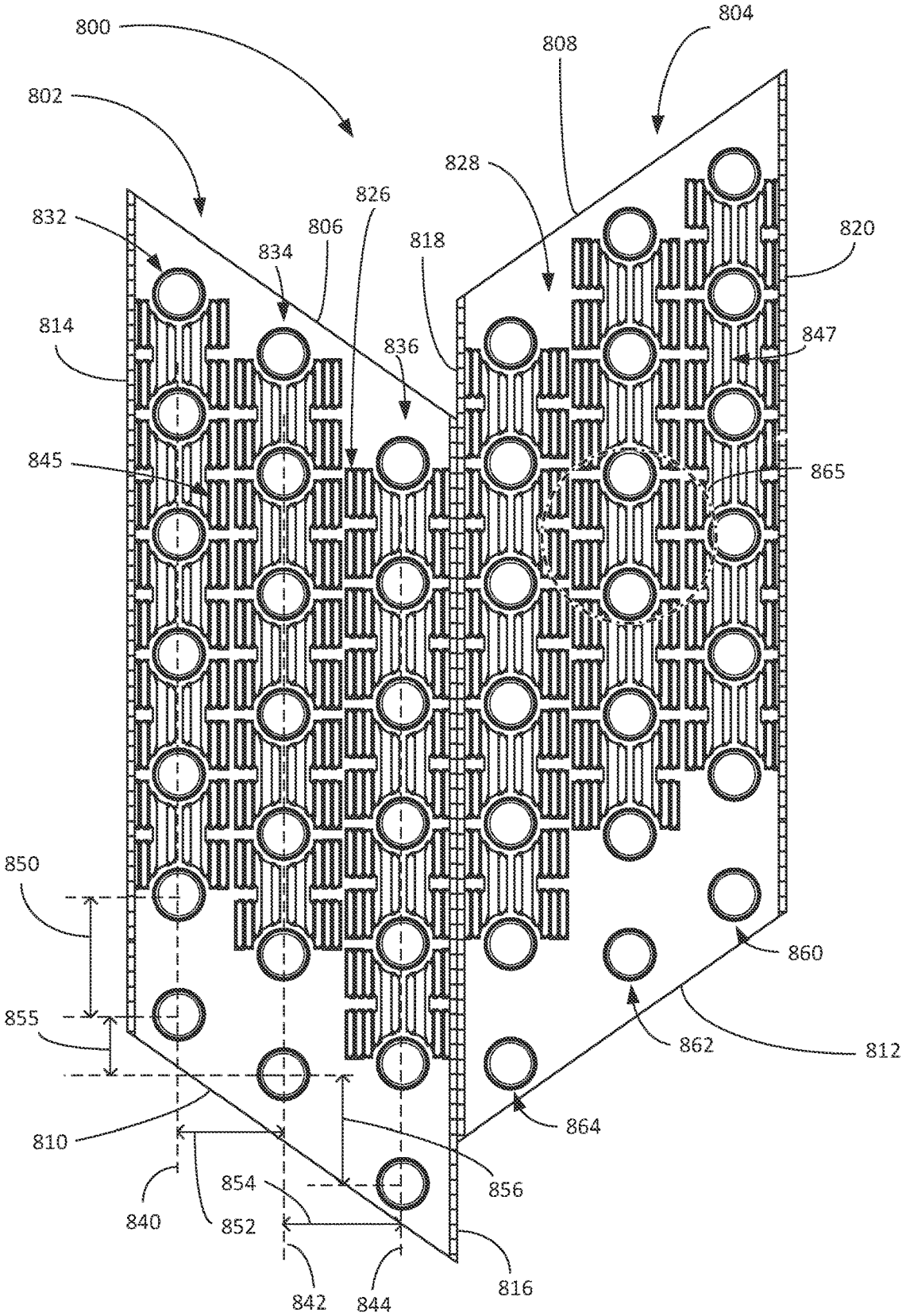
FIG. 8 is a front view of louvered fins each defining three rows of holes, according to another embodiment of the present disclosure.

FIG. 8 illustrates a front view of fins 800, according to another embodiment of the present disclosure. Specifically, fins 800 may include fin 802 and fin 804, which may be positioned adjacent to one another as shown in in FIG. 8. For example, fins 802 and 804 may be standalone or fins 802 and 804 may be joined or otherwise connected (e.g., via welding, bolted connection, threaded connection, or the like or may be made from the same integral piece). It is understood that fins 802 and 804 may be positioned next to fins that are identical or similar to fins 802 and 804. For example, multiple such fins may be disposed adjacent to each other and may be stacked together with refrigerant tubes.

Fins 802 and 804 may be die stamped on a metallic (e.g., aluminum) sheet to achieve the design illustrated in FIG. 8. However, it is understood that different manufacturing techniques may be used to created fins 802 and 804 (e.g., casting). It is further understood that fins 802 and 804 may be made of a different material (e.g., copper, steel, alloy, etc.). In one example, fins 802 and 804 may be die stamped together and/or may be simultaneously or subsequently separated.

Fin 802 and fin 804 may have leading edge 806 and leading edge 808, respectively. Leading edge 806 and leading edge 808 may be linear and may be angled. Fin 802 and fin 804 may similarly have trailing edge 810 and trailing edge 812, respectively. Trailing edge 806 and trailing edge 808 may be linear and may be parallel to leading edge 806 and leading edge 808, respectively. It is understood that leading edge 806 and leading edge 808 may not be parallel. Fin 802 may further include left edge 814 and right edge 816 that are linear and parallel. Fin 804 may further include left edge 818 and right edge 820 that are linear and parallel. Fin 802 and fin 804 may each be parallelograms and/or may be mirror images or transpositions of one another.

As shown in FIG. 8, fin 802 and fin 804 may each include three sets of holes arranged in three columns. Each set of holes may include several holes equally spaced along an axis. Each axis of each set of holes may be parallel with each other axis of each set of holes. Each axis of each set of holes may also be parallel to left edge 814, right edge 816, left edge 818 and right edge 820.

Figure 11:
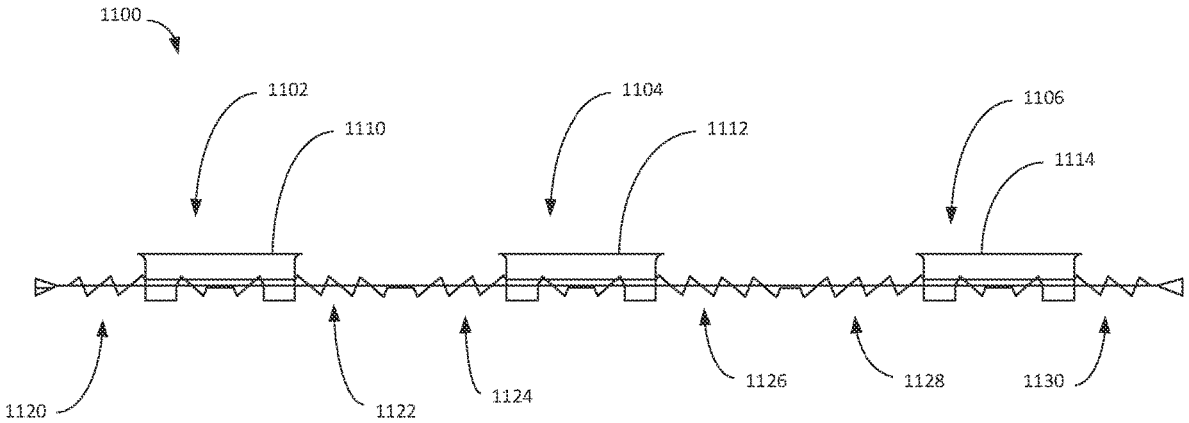
FIG. 11 is a side cross-sectional view of a louvered fin, according to an embodiment of the present disclosure.

Each hole of the holes in fin 802 and 804 may be the same or similar to first hole 110-1 of FIG. 1B and/or hole 1110, hole 1112 and/or hole 1114 of FIG. 11. Each hole of the set of holes in fins 802 and 804 may be designed to receive one or more heat exchange tube (e.g. a refrigerant tube) that may be designed to receive and circulate a fluid (e.g., a refrigerant) and may exchange thermal energy with the heat exchange tube and/or fluid.

Surface 826 may be defined between leading edge 806, trailing edge 810, left edge 814 and right edge 816. Surface 828 may be defined between leading edge 808, trailing edge 812, left edge 818, and right edge 820. Surface 826 may include louvers 845 that my extend entirely between left edge 814 and right edge 816 and may extend partially between leading edge 806 and trailing edge 810. Surface 828 may include louvers 847 that may extend entirely between left edge 818 and right edge 820 and may extend partially between leading edge 808 and trailing edge 812. Louvers 845 and/or 847 may be the same or similar to louver 308 of FIG. 3. Louvers in region 865 are illustrated in greater detail in FIG. 10.

Fin 802 may include set of holes 832 which may include several holes arranged along axis 840, set of holes 834, which may be arranged along axis 842, and set of holes 836, which may be arranged along axis 844. Each of set of holes 832, set of holes 834, and set of holes 836 may include the same number of holes and may include holes that are equally distributed along axis 840, 842, and 844, respectively and separated along each respective axis by the same distance. For each hole of the set of holes 832, set of holes 834, and set of holes 836 may be spaced apart along each respective axis 840, axis 842, and axis 846 by an amount 850. In one example, amount 850 may be between 0.75 and 1 inch.

Axis 840 of set of holes 832 may be horizontally offset from axis 842 of set of holes 834 by value 852. In one example, value 852 may be between 0.5 and 0.75 inch. Similarly, axis 842 of set of holes 834 may be offset from axis 844 of set of holes 836 by valve 854. In one example, value 854 may be between 0.75 and 1 inch. It is understood that value 854 may be the same or substantially the same (e.g., within a manufacturing tolerance) of value 850. With value 854 and value 850 being the same or substantially the same, similar tooling and parts may be used between the respective holes of fin 802.

Holes of set of holes 832 may be vertically offset from holes of set of holes 834 by value 855. Holes of set of holes 834 may be vertically offset from holes of set holes 836 by value 856. Value 856 may be larger than value 855. It is understood that value 856 may be calculated based on value 850, value 852, and/or value 855. It is further understood that value 854 may be larger than value 852 and that more louver peaks and/or valleys may exist between set of holes 834 and set of holes 836 than between set of holes 832 and set of holes 834. In one example, two consecutive holes of set of holes 834 may together with two counterpart holes of set of holes 834 may define a substantially obtuse trapezoidal matrix. Similarly, two consecutive holes of set of holes 862 may together with two counterpart holes of set of holes 864 may define a substantially obtuse trapezoidal matrix of fin 804.

Fin 804 may be designed such that it mirrors or transposes the design of fin 802. For example, fin 804 may similarly include set of holes 860, which may be similar to set of holes 832, set of holes 862, which may be similar to set of holes 834, and set of holes 864, which may be similar to set of holes 836. The holes of set of holes 860, 862 and 864 may each be equally distanced along respective parallel axes spaced apart by value 850. It is understood that set of holes 864 may be positioned between set of holes 862 and set of holes 836. It is further understood that at least some holes of set of holes 864 and set of holes 836 may be horizontally aligned.

Set of holes 860 may be offset horizontally from set of holes 862 by value 854. Set of holes 862 may be offset horizontally from set of holes 864 by amount 854. In one example, value 854 may be between 0.5 and 1.0 inch. Holes of set of holes 860 may be vertically offset from holes of set of holes 862 by value 855. In one example, value 855 may be between 0.25 and 0.5 inch. Holes of set of holes 862 may be vertically offset from holes of set holes 864 by value 856. Value 856 may be larger than value 855.

As shown in FIG. 8, louvers 845 and louvers 847 may only extend across a portion of fin 802 and fin 804, respectively. For example, louvers 845 may extend between left edge 814 and right edge 816 of fin 802 and may extend between left edge 818 and right edge 820 of fin 804. However, louvers 845 of fin 802 may not extend all the way to leading edge 806 and/or trailing edge 810 and louvers 847 of fin 804 may not extend all the way to leading edge 801 and trailing edge 812.

For example, set of holes 832 may include a hole nearest trailing edge 810 and a hole second nearest trailing edge 810, set of holes 834 may include a hole nearest trailing edge 810 and a hole second nearest trailing edge 810, and set of holes 836 may include a hole nearest trailing edge 810 and a hole second nearest trailing edge 810. As shown in FIG. 8, louvers 845 may terminate at the holes second nearest trailing edge 810 such that surface 825 is without louvers at the holes of set of holes 832, 834, 836 nearest trailing edge 810. Surface 825 without louvers may more easily guide condensation to and past trailing edge 810 and ultimately off of fin 802. It is understood that louvers 845 may alternatively terminate immediately prior to or immediately after the holes of second nearest trailing edge 810. It is further understood that louvers 847 may similarly terminate prior to leading edge 808 and trailing edge 812.

Figure 12:
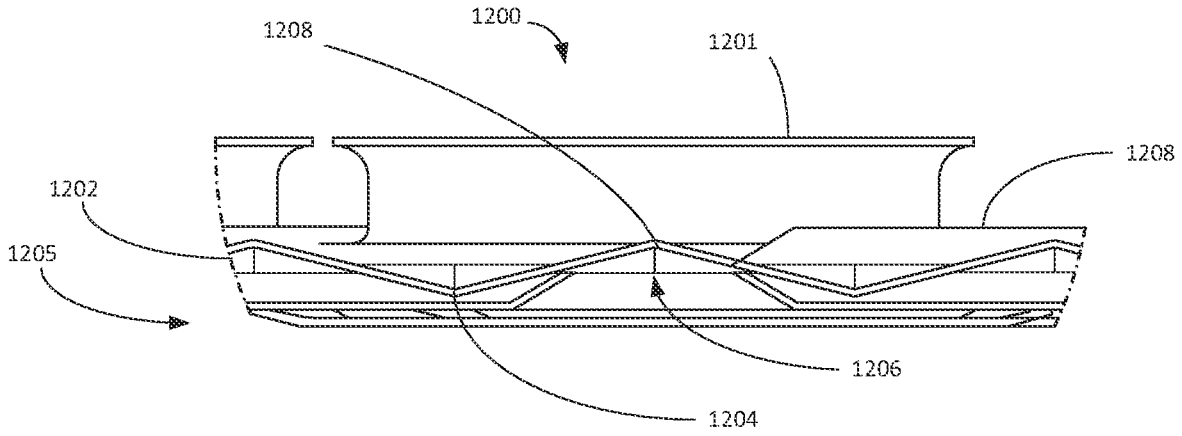
FIG. 12 is a side cross-sectional view of an edge of a louvered fin, according to an embodiment of the present disclosure.

Each of left edge 814, right edge 816, left edge 818, and right edge 820 may include a rippled edge, such as a zig-zag pattern (as shown in FIG. 5 and/or FIG. 12). For example, the rippled edge may include alternating peaks and valleys. It is understood that the peaks and valleys along each right edge and trailing edge may be oriented perpendicular to the peaks and valleys of louvers 845 and louvers 847.

Figure 9:
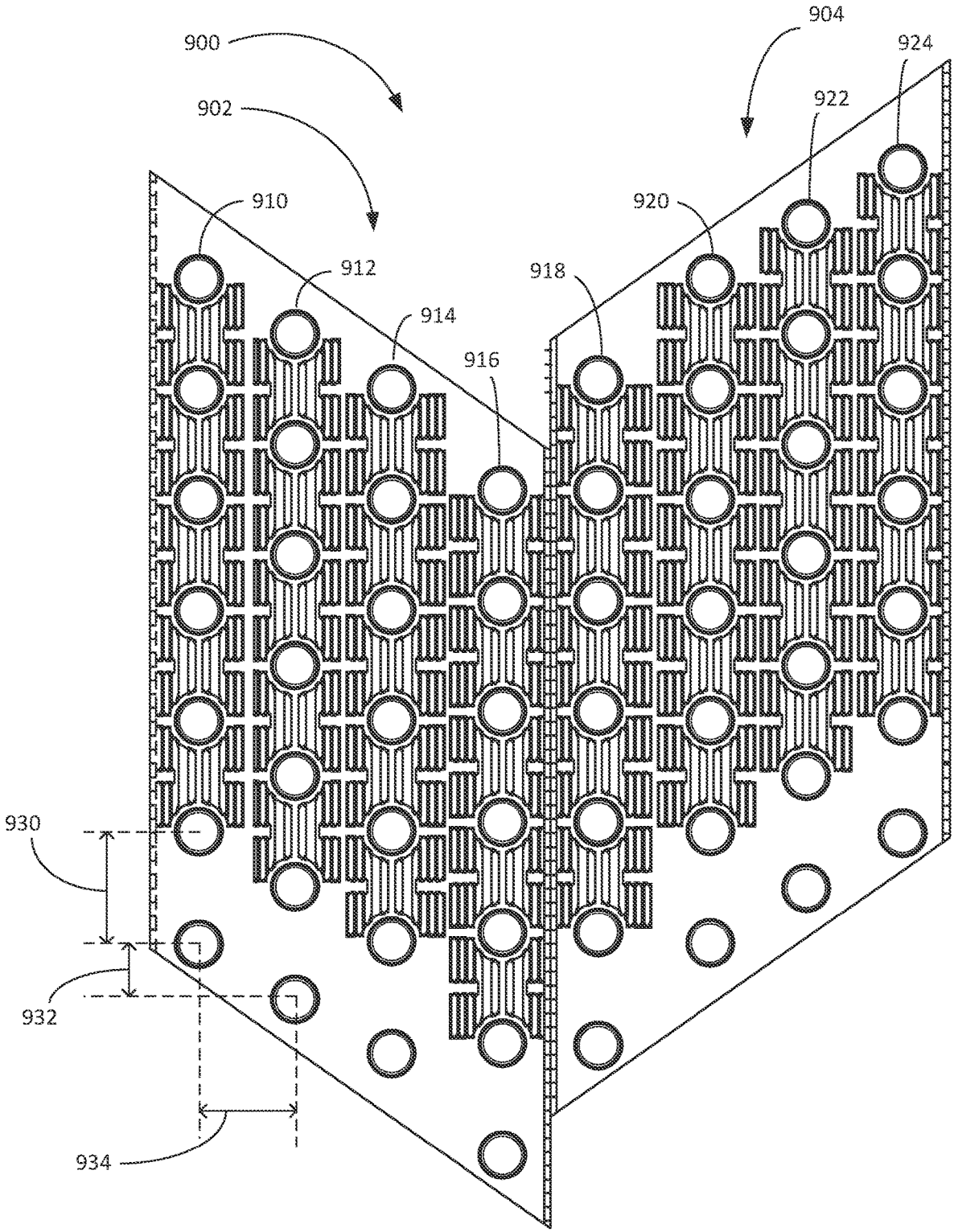
FIG. 9 is a front view of louvered fins each defining four rows of holes, according to another embodiment of the present disclosure.

FIG. 9 illustrates a front view of fins 900, according to another embodiment of the present disclosure. Specifically, fins 900 may include fin 902 and fin 904, which may be positioned adjacent to one another as shown in in FIG. 9. Fins 902 and 904 may be the same as or substantially the same as fins 802 and 804, except that each of fins 902 and 904 may include four sets of holes arranged in four columns.

Fin 902 may include set of holes 910, set of holes 912, set of holes 914, and set of holes 916. Set of holes 912, set of holes 914, and set of holes 916 may be the same as or substantially the same as set of holes 832, set of holes 834, and set of holes 836 of FIG. 8 and may include the same spacing and arrangement as set of holes 832, set of holes 834, and set of holes 836. Fin 902 may further include set of holes 910 which may be arranged along an axis parallel to that of set of holes 912.

Set of holes 910 may include several holes that are equally spaced apart. For example, each hole may be spaced apart by amount 930, which may be the same as amount 850 of FIG. 8. Holes of set of holes 910 may be vertically offset from holes of set of holes 912 by value 932, which may be the same as value 855 of FIG. 8. Holes of set of holes 910 may be horizontally spaced apart from holes of set of holes 912 by value 934, which may be the same as value 852 of FIG. 8

Fin 904 may be designed such that it mirrors or transposes the design of fin 902. For example, fin 904 may similarly include set of holes 924, which may be similar to set of holes 910, set of holes 922, which may be similar to set of holes 912, set of holes 920, which may be similar to set of holes 914, and set of holes 918, which may be similar to set of holes 916. The holes of set of holes 924, 922, 920, and 918 may each be distanced along respective parallel axes spaced apart by value 930. It is understood that set of holes 918 may be positioned between set of holes 918 and set of holes 916. It is further understood that at least some holes of set of holes 916 and set of holes 918 may be horizontally aligned.

Figure 10:
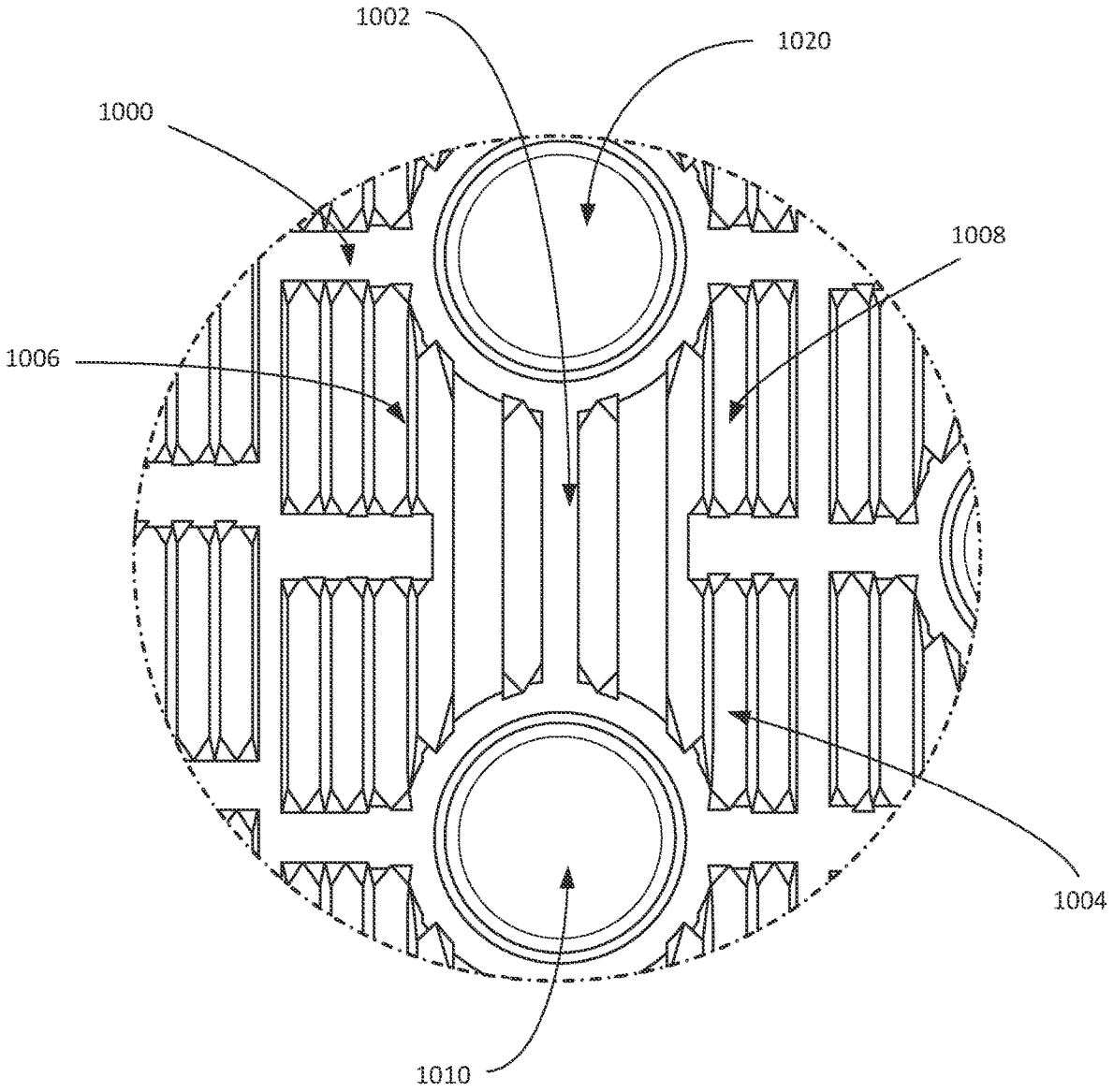
FIG. 10 is a focused view the louvers of a louvered fin, according to another embodiment of the present disclosure.

FIG. 10 illustrates region 1000, which may be the same as or similar to 865 of FIG. 8, according to another embodiment of the present disclosure. Region 1000 may extend around a circumference of a hole in the set of holes. For example, region 1000 may surround a hole in set of holes 836 and/or set of holes 862 of FIG. 8 and/or set of holes 916 and/or set of holes 920 of FIG. 9. For example, louvers 1004 may be formed between hole 1010 and hole 1020 to define an X-shape pattern of louvers along a surface 1000 of the fin.

In one example, the fin may include eleven columns of louvers 1004. For example, the X-shape may include left side 1006, which may include six columns of louvers 1004 and right side 1008 which may include five columns of louvers. In the embodiment illustrated in FIG. 10, holes 1010 and 1020 may be offset a greater distance from a set of holes on the left-hand side than a set of holes on the right hand side. As a result, more columns of louvers 1004 may be positioned on left side 1006 of louvers 1004 than right side 1008.

It is understood that louvers 1004 may be a different shape instead of X-shaped. For example, louvers 1004 may form continuous columns, may extend horizontally instead of vertically, or may be concentric circles. It is further understood that right side 1008 of louvers 1004 may include the same number or a greater number of columns than left side 1006.

FIG. 11 illustrates a cross-sectional view of a fin and three holes, according to another embodiment of the present disclosure. Specifically, fin 1100 includes hole 1110 of set of holes 1102, hole 1112 of set of holes 1104, and hole 1114 of set of holes 1106. Fin 1100 may be the same or similar to fin 802 of FIG. 8, for example. Set of holes 1102 may be the same or similar to set of holes 832, set of holes 1104 may be the same or similar to set of holes 834, and set of holes 1106 may be the same or similar to set of holes 836 of FIG. 8.

As shown in FIG. 11, hole 1112 may be positioned closer to hole 1110 than to hole 1114. Hole 1110 may be surrounded by louvers 1120 and 1122, which may include alternating peaks and valleys. Similarly hole 1112 may be surrounded by louvers 1124 and 1126, which may include alternating peaks and valleys. While louver 1124 may be similar to louver 1120, unlike louver 1122 on the right side of hole 1110, which includes three peaks and three valleys, louver 1126 on the right side if hole 1112 may include four peaks and four valleys. Hole 1114 may be surrounded by louvers 1128, which may include four peaks and four valleys, and louver 1130, which may include three alternating peaks and valleys.

As shown in FIG. 11, the louvers may be slanted or biased towards each respective hole. For example, louvers 1126 may be slanted towards hole 1112 and louvers 1128 may be slanted towards hole 1114. It is understood that any other peak and/or valley design may be used, including different pitch, angles, depth, height, number of columns, width, and the like.

FIG. 12 illustrates a cross-sectional view of a rippled edge of a fin (e.g., left edge or right edge), according to another embodiment of the present disclosure. Specifically, edge 1205 may be the left edge or right edge of a fin extending between a trailing edge and a leading edge. Edge 1205 may include ripple 1202 which may include alternating peaks 1208 and valleys 1204. Alternating peaks 1208 and valleys 1204 may be similar to louvers (e.g., louvers 1128 of FIG. 11) in that each may increase the surface area for a given portion of the fin, which may facilitate thermal energy transfer with the exterior environment in which the fin is situated (e.g., air).

Hole 1200 may be positioned adjacent to and interior to ripple 1202. Hole 1201 may extend from and through surface 1206. Ripple 1202 may also extend from surface 1206. As shown in FIG. 12, louvers 1208 may also extend from surface 1206 and may be positioned between ripple 1202 and hole 1201. In one example, louver 1208 may be the same as or similar to louvers 1004 of FIG. 10.

To this end, the present disclosure provides a unique design for louvered fins. The louvered fin is particularly designed for condensate draining, utilizing larger louver angle, but implementing plurality of louvers in contrast to conventional lanced fin. With such configuration of the louvered fin, it is possible to maintain a high convective heat transfer coefficient. Besides contributing for good condensate drainage, the louvered fin of the present disclosure also restarts boundary layers of convective heat transfer with small diameter refrigerant tubes, for example 7 mm tubes, at an inclined angle of attack for the airflow across the louvered fins. Additionally, the geometrical characteristics of the louvered fin, such as the obtuse trapezoidal matrix of the holes, may aid easy draining of condensate.

While aspects of the present disclosure have been particularly shown and described with reference to the embodiments above, it will be understood by those skilled in the art that various additional embodiments may be contemplated by the modification of the disclosed features without departing from the spirit and scope of what is disclosed. Such embodiments should be understood to fall within the scope of the present disclosure as determined based upon the claims and any equivalents thereof.

What is claimed is:

1. A heat exchange fin comprising:
a leading edge;
a trailing edge opposite to the leading edge;
a surface extending between the leading edge and the trailing edge, the surface defining a plurality of holes, the surface comprising:
a first edge and a second edge opposite the first edge, the first edge and the second edge different from the leading edge and the trailing edge, wherein each of the first edge and the second edge comprises alternating peaks and valleys;
a first set of holes of the plurality of holes defined along a first axis;
a second set of holes of the plurality of holes defined along a second axis, parallel to the first axis;
a first number of fins disposed between the first set of holes and the second set of holes;
a third set of holes of the plurality of holes defined along a third axis, parallel to the second axis, the second set of holes positioned between the third set of holes and the first set of holes; and
a second number of fins disposed between the second set of holes and the third set of holes, wherein the second number is greater than the first number;
wherein each of the holes of the first set of holes, the second set of holes, and the third set of holes are spaced apart along a first direction parallel to the first axis by a first amount;
wherein the first set of holes and the second set of holes are offset along a second direction perpendicular to the first direction by a second amount; and
wherein the third set of holes is offset from the second set of holes along the second direction by a third amount different than the second amount.

2. The heat exchange fin of claim 1, wherein the second set of holes and the third set of holes define a substantially obtuse trapezoidal matrix.

3. The heat exchange fin of claim 1, wherein the surface further comprises a fourth set of holes of the plurality of holes defined along a fourth axis, parallel to the first axis.

4. The heat exchange fin of claim 3, wherein the fourth set of holes of the plurality of holes is positioned such that the first set of holes is positioned between the fourth set of holes and the second set of holes.

5. The heat exchange fin of claim 4, wherein the fourth set of holes is offset from the first set of holes along the second direction by the second amount.

6. The heat exchange fin of claim 1, wherein the third set of holes is offset from the second set of holes along the first direction by a fourth amount different from the first amount.

7. The heat exchange fin of claim 1, wherein the first set of holes comprises a first hole near the trailing edge and a second hole between the first hole and the trailing edge, the second set of holes comprises a third hole near the trailing edge and a fourth hole between the third hole and the trailing edge, and the third set of holes comprises a fifth hole near the trailing edge and a sixth hole between the first hole and the trailing edge, and wherein the fins do not extend between the first hole and the trailing edge, the third hole and the trailing edge, and the fifth hole and the trailing edge.

8. The heat exchange fin of claim 1, wherein each hole of the plurality of holes is configured to receive one or more refrigerant tubes and the surface is configured to exchange thermal energy with the one or more refrigerant tubes.

9. The heat exchange fin of claim 1, wherein a first distance between a center of a first hole of the first set of holes and a center of a second hole of the second set of holes is equal to a second distance between the center of the second hole and a center of a third hole of the third set of holes.

10. The heat exchange fin of claim 1, wherein a circumference of an imaginary circle with a center at a center of a first hole of the second set of holes passes through a center of a second hole of the first set of holes and passes through a center of a third hole in the third set of holes.

11. The heat exchange fin of claim 1, wherein the first number of fins and the second number of fins are louvered fins.

12. The heat exchange fin of claim 1, wherein the surface comprises fins extending across a majority of the surface.

13. A heat exchanger comprising:
one or more refrigerant tubes configured to receive and guide a fluid;
a heat exchange fin configured to exchange thermal energy with the one or more refrigerant tubes, the heat exchange fin comprising:
a leading edge;
a trailing edge opposite to the leading edge;
a surface extending between the leading edge and the trailing edge, the surface defining a plurality of holes, each hole of the plurality of holes sized and configured to receive the one or more refrigerant tubes, the surface comprising:
a first set of holes of the plurality of holes defined along a first axis;
a second set of holes of the plurality of holes defined along a second axis, parallel to the first axis;

a third set of holes of the plurality of holes defined along a third axis, parallel to the second axis, the second set of holes positioned between the third set of holes and the first set of holes;

wherein the first set of holes comprises a first hole near the trailing edge and a second hole between the first hole and the trailing edge, the second set of holes comprises a third hole near the trailing edge and a fourth hole between the third hole and the trailing edge, and the third set of holes comprises a fifth hole near the trailing edge and a sixth hole between the first hole and the trailing edge, and wherein the fins do not extend between the first hole and the trailing edge, the third hole and the trailing edge, and the fifth hole and the trailing edge;

wherein each of the holes of the first set of holes, the second set of holes, and the third set of holes are spaced apart along a first direction parallel to the first axis by a first amount;

wherein the first set of holes and the second set of holes are offset along a second direction perpendicular to the first direction by a second amount; and wherein the third set of holes is offset from the second set of holes along the second direction by a third amount different than the second amount, and the second set of holes is offset from the third set of holes along the first direction by a fourth amount different from the first amount.

14. The heat exchanger of claim 13, further comprising:

a second heat exchange fin configured to exchange thermal energy with the one or more refrigerant tubes, the second heat change fin comprising:

a second leading edge;

a second trailing edge opposite to the second leading edge;

a second surface extending between the second leading edge and the second trailing edge, the second surface defining a second plurality of holes, each hole of the second plurality of holes sized and configured to receive the one or more refrigerant tubes, the second surface comprising:

a primary set of holes of the plurality of holes defined along a primary axis;

a secondary set of holes of the plurality of holes defined along a secondary axis, parallel to the primary axis;

a tertiary set of holes of the plurality of holes defined along a tertiary axis, parallel to the secondary axis, the secondary set of holes positioned between the tertiary set of holes and the primary set of holes;

wherein each of the holes of the primary set of holes, the secondary set of holes, and the tertiary set of holes are spaced apart along the first direction by the first amount;

wherein the primary set of holes and the secondary set of holes are offset along the second direction perpendicular to the first direction by the second amount; and wherein the tertiary set of holes is offset from the secondary set of holes along the second direction by the third amount different than the second amount.

15. The heat exchanger of claim 14, wherein the second heat exchange fin is positioned adjacent to the first heat exchange fin.

16. The heat exchanger of claim 15, wherein the primary axis is parallel to the first axis, and wherein the tertiary set of holes is positioned immediately between the secondary set of holes and the third set of holes.

17. The heat exchanger of claim 13, wherein the second set of holes and the third set of holes define a substantially obtuse trapezoidal matrix.

18. The heat exchanger of claim 13, wherein the surface further comprises a fourth set of holes of the plurality of holes defined along a fourth axis, parallel to the first axis, and the fourth set of holes of the plurality of holes is positioned such that the first set of holes is positioned between the fourth set of holes and the second set of holes.

19. The heat exchanger of claim 18, wherein the fourth set of holes is offset from the first set of holes along the second direction by the second amount.

20. A heat exchange fin comprising:

a leading edge;

a trailing edge opposite to the leading edge;

a surface extending between the leading edge and the trailing edge, the surface defining a plurality of holes, the surface comprising:

a first set of holes of the plurality of holes defined along a first axis;

a second set of holes of the plurality of holes defined along a second axis, parallel to the first axis;

a third set of holes of the plurality of holes defined along a third axis, parallel to the second axis, the second set of holes positioned between the third set of holes and the first set of holes, wherein each of the holes of the first set of holes, the second set of holes, and the third set of holes are spaced apart along a first direction parallel to the first axis by a first amount; and wherein the first set of holes and the second set of holes are offset along a second direction perpendicular to the first direction by a second amount wherein the third set of holes is offset from the second set of holes along the second direction by a third amount different than the second amount, the third amount is greater than the second amount.

21. The heat exchange fin of claim 20, wherein the first set of holes is offset from the second set of holes along the first direction by a fourth amount, wherein the second set of holes is offset from the third set of holes along the first direction by a fifth amount, wherein the fifth amount is greater than the fourth amount.

22. A heat exchange fin comprising:

a leading edge;

a trailing edge opposite to the leading edge;

a surface extending between the leading edge and the trailing edge, the surface defining a plurality of holes, the surface comprising:

a first set of holes of the plurality of holes defined along a first axis;

a second set of holes of the plurality of holes defined along a second axis, parallel to the first axis;

a first number of fins disposed between the first set of holes and the second set of holes;

a third set of holes of the plurality of holes defined along a third axis, parallel to the second axis, the second set of holes positioned between the third set of holes and the first set of holes; and a second number of fins disposed between the second set of holes and the third set of holes, wherein the second number is greater than the first number;

wherein a first distance between a center of a first hole of the first set of holes and a center of a second hole of the second set of holes is equal to a second distance between the center of the second hole and a center of a third hole of the third set of holes;

wherein each of the holes of the first set of holes, the second set of holes, and the third set of holes are spaced apart along a first direction parallel to the first axis by a first amount;

wherein the first set of holes and the second set of holes are offset along a second direction perpendicular to the first direction by a second amount; and wherein the third set of holes is offset from the second set of holes along the second direction by a third amount different than the second amount.

23. A heat exchange fin comprising:

a leading edge;

a trailing edge opposite to the leading edge;

a surface extending between the leading edge and the trailing edge, the surface defining a plurality of holes, the surface comprising:

a first set of holes of the plurality of holes defined along a first axis;

a second set of holes of the plurality of holes defined along a second axis, parallel to the first axis;

a first number of fins disposed between the first set of holes and the second set of holes;

a third set of holes of the plurality of holes defined along a third axis, parallel to the second axis, the second set of holes positioned between the third set of holes and the first set of holes; and a second number of fins disposed between the second set of holes and the third set of holes, wherein the second number is greater than the first number;

wherein a circumference of an imaginary circle with a center at a center of a first hole of the second set of holes passes through a center of a second hole of the first set of holes and passes through a center of a third hole in the third set of holes;

wherein each of the holes of the first set of holes, the second set of holes, and the third set of holes are spaced apart along a first direction parallel to the first axis by a first amount;

wherein the first set of holes and the second set of holes are offset along a second direction perpendicular to the first direction by a second amount; and wherein the third set of holes is offset from the second set of holes along the second direction by a third amount different than the second amount.

* * * * *